United States Patent [19]

Mohr

[11] Patent Number: 4,757,731

[45] Date of Patent: Jul. 19, 1988

[54] METHOD AND APPARATUS FOR SELECTING THE BIAS UPON STACKS OF SHEETS IN GUILLOTINE TYPE CUTTING MACHINES

[76] Inventor: Wolfgang Mohr, Hundshager Weg 42, D-6238 Hofheim, Fed. Rep. of Germany

[21] Appl. No.: 41,730

[22] Filed: Apr. 23, 1987

[30] Foreign Application Priority Data

Apr. 24, 1986 [DE] Fed. Rep. of Germany ..... 3613835

[51] Int. Cl.[4] ..... B26D 7/04

[52] U.S. Cl. ..... 83/13; 83/71; 83/72; 83/364; 83/452; 83/461; 269/329

[58] Field of Search ..... 83/13, 71, 72, 452, 83/360, 364, 378, 461; 269/329

[56] References Cited

U.S. PATENT DOCUMENTS

| | | | |
|---|---|---|---|
| 2,122,186 | 6/1938 | Southworth | 83/378 |
| 2,570,873 | 10/1951 | Seybold | 83/378 |
| 2,621,733 | 12/1952 | Seybold | 83/378 |
| 2,781,844 | 2/1957 | Pearson et al. | 83/378 |

FOREIGN PATENT DOCUMENTS 1093774 12/1960 Fed. Rep. of Germany .

*Primary Examiner*—Frank T. Yost
*Attorney, Agent, or Firm*—Peter K. Kontler

[57] ABSTRACT

A guillotine type cutting machine wherein the length of cuts to be made in stacks of sheets determines the force with which a hold-down device bears upon a stack in the course of the cutting operation to prevent stray movements of the sheets. The force varies as a function of the length of the contemplated cuts and is regulated in such a way that the pressure of the hold-down device per unit area of a larger or smaller stack containing identical numbers and types of sheets is the same.

19 Claims, 4 Drawing Sheets

METHOD AND APPARATUS FOR SELECTING THE BIAS UPON STACKS OF SHEETS IN GUILLOTINE TYPE CUTTING MACHINES

BACKGROUND OF THE INVENTION

The present invention relates to machines for cutting stacks of paper sheets or the like, and more particularly to improvements in guillotine type cutting or severing machines wherein a hold-down device in the form of a beam or the like is used to exert pressure upon the stack in the course of the severing operation so as to prevent uncontrolled stray movements of sheets and/or of the entire stack. The invention also relates to improvements in a method of cutting stacks of overlapping sheets in a machine of the above outlined character.

The quality of cuts which are made in a guillotine type severing machine depends to a considerable extent on the magnitude of the force with which the stack is held in the course of the severing operation. If the bias of the hold-down device is excessive, the device is likely to deface and/or otherwise damage the topmost sheet or sheets of the stack. On the other hand, the knife is likely to move one or more sheets or the entire stack relative to the support if the bias of the hold-down device is insufficient. The magnitude of the force which is to be applied by the hold-down device also depends on the characteristics of the material of the sheets, i.e., relatively soft material must be held down with a greater force than a relatively hard stock. Still further, the magnitude of the force which is applied by the hold-down device depends on the size (format) of the stack to be cut, and more particularly on the length of the proposed cut.

Conventional guillotine type cutting machines are provided with adjusting means for selecting the bias which the hold-down device applies to the material to be severed in the course of the cutting operation. The adjusting means is set by hand which is not satisfactory in many cases, e.g., because the quality of the severing operation is overly dependent upon the experience and/or conscientiousness of the operator. Moreover, this necessitates the presence of an attendant whenever it becomes necessary to shift from the cutting of one type of stock to the cutting of a different type of stock. Typical examples of materials which are to be cut in a guillotine type machine are stacks of sheets each of which consists of a large number of labels. A large stack is first subdivided into two or more smaller stacks, and each smaller stack is thereupon cut again so that it ultimately yields a number of stacks each containing overlapping single labels. If the subdivision of a large stack into stacks of individual labels is to take place in a series of successive operations, the bias of the hold-down device must be adjusted upon completion of each cut or, at the very least, at relatively frequent intervals. This is a cumbersome and time-consuming operation.

German Auslegeschrift No. 1 093 774 discloses a cutting machine wherein the force with which the hold-down device bears upon a stack is assumed to be dependent upon the length of the cut, and such force can be selected in response to signals which are generated by means for monitoring the format of the stack. This mode of operation allows for a certain degree of automation but is not entirely satisfactory because the sensors merely monitor the length of the cut to be made but cannot adequately take into consideration other parameters which affect the quality of the cutting operation.

OBJECTS AND SUMMARY OF THE INVENTION

An object of the invention is to provide a novel and improved method of automatically selecting the optimum bias of a hold-down device in a guillotine type or like cutting machine by full consideration of all important parameters which influence the cutting operation.

Another object of the invention is to provide a method which can be practiced to ensure the making of satisfactory cuts regardless of the frequency at which the bias of the hold-down device must be altered in a guillotine type cutting machine.

A further object of the invention is to provide a novel and improved machine which can be used for the practice of the above outlined method.

An additional object of the invention is to provide a machine wherein the bias of the hold-down device for stacks of paper sheets, metallic sheets, plastic sheets or other types of sheets can be selected with a high degree of accuracy and without any assistance on the part of the operator.

Still another object of the invention is to provide the machine with novel and improved means for selecting and altering the force which the hold-down device exerts upon a stack of sheets in the course of the cutting operation.

Another object of the invention is to provide novel and improved means for pushing or pulling the hold down device toward the commodities at the severing station.

One feature of the present invention resides in the provision of a method of regulating the force with which stacks of overlapping sheets are biased against a support during severing in a machine wherein stacks requiring longer and shorter cuts are severed in a predetermined or random sequence. The method comprises the steps of monitoring the stacks in order to ascertain the lengths of the cuts to be made therein and generating signals whose characteristics are indicative of the ascertained lengths, selecting a basic force, and altering the basic force for each stack as a function of the characteristics of the respective signal so that the applied force is greater when the cut to be made is longer and lesser when the cut to be made is shorter.

The force is applied to stacks by a hold-down device which is movable with reference to the support to exert pressure upon a stack on the support. The altering step preferably includes varying the baisc force in such a way that the pressure per unit area of contact between the hold-down device and the stack on the support is at least substantially constant regardless of the length of the cut to be made.

The selecting step preferably includes selecting the basic force for a cut of maximum length in a stack containing a particular sheet material, and the altering step then includes reducing the basic force substantially proportionally with a reduction of the length of the cut to be made.

The method can further comprise the step of storing a plurality of data pertaining to different types of stacks and denoting variations of the basic force in relation to the lengths of the cuts to be made in the respective types of stacks. The selecting step then comprises selecting one of the plurality of data and the altering step comprises choosing from selected data that value which corresponds to the length of the cut to be made. The storing step can include arbitrarily varying an auxiliary value until it corresponds to the desired force, and thereupon memorizing that auxiliary value which corresponds to the desired force. The remaining values of the data can be calculated on the basis of memorized auxiliary values.

The stored data preferably denote variations of the basic force as a function of the length of the cuts to be made in the respective types of stacks. Such data can be represented by curves, e.g., in the form of straight lines.

The monitoring step preferably includes ascertaining the lengths of the cuts to be made in or very close to the plane in which the guillotine type knife of the machine makes cuts in the stacks on the support.

In accordance with a presently preferred embodiment of the method, the selecting step includes determining a different basic force for each length of the cut and the determining step includes subjecting a stack in which a cut of given length is to be made to the action of a compressing force so that the respective dimension of the stack is reduced under the action of the compressing force, measuring the extent of reduction of the dimension, and utilizing the result of such measurement to calculate the corresponding basic force.

Another feature of the invention resides in the provision of a severing machine for making shorter and longer cuts in stacks of overlapping sheets. The machine comprises a support (e.g., a table) for a stack to be cut, a hold-down device which is movable with reference to the support to apply to the stack on the support a force during severing of the stack, and control means for regulating the force. The control means includes means for monitoring the stack on the support and for generating signals whose characteristics denote the length of the cut to be made in the stack, and means for selecting for each stack a basic force which is altered as a function of the characteristics of the corresponding signal so that the force is greater when the cut to be made is longer and lesser when the cut to be made is shorter.

The hold-down device is preferably disposed at a level above the support, and the monitoring means is preferably installed in or on the support beneath the hold-down device.

The monitoring means can include a row of signal transmitting sensors, and the number of sensors which transmit signals in the course of a monitoring operation is a function of the extent to which the row is overlapped by a stack on the support.

The control means preferably further comprises an evaluating circuit which is responsive to signals from the monitoring means, i.e., from sensors forming the overlapped portion or part of the row of sensors. The control means can further comprise at least one memory for data denoting forces for cuts of different lengths, and the aforementioned evaluating circuit can constitute the means which addresses the memory in response to signals from sensors forming the overlapped part of the row of sensors in or on the support.

The control means can also comprise at least one fluid-operated cylinder and piston unit for moving the hold-down device toward the support, and means for varying the pressure of fluid in the cylinder and piston unit. Such varying means can comprise a source of pressurized fluid (e.g., a pump which draws oil from a reservoir), conduit means for connecting the source with the cylinder and piston unit, and adjustable valve means in the conduit means. The means for adjusting the valve means can include the aforementioned evaluating circuit which receives first signals from the monitoring means and second signals from the selecting means (such second signals denote the basic force for different types of stacks). The aforementioned memory contains information denoting the variations of the basic forces, and the control means further comprises means (e.g., a hydroelectronic transducer) for transmitting to the evaluating circuit signals denoting the actual pressure of fluid in the cylinder and piston unit.

The control means can further comprise a second memory which can transmit to the evaluating circuit information denoting basic forces for different types of stacks as selected in the course of a preceding series of cutting operations.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
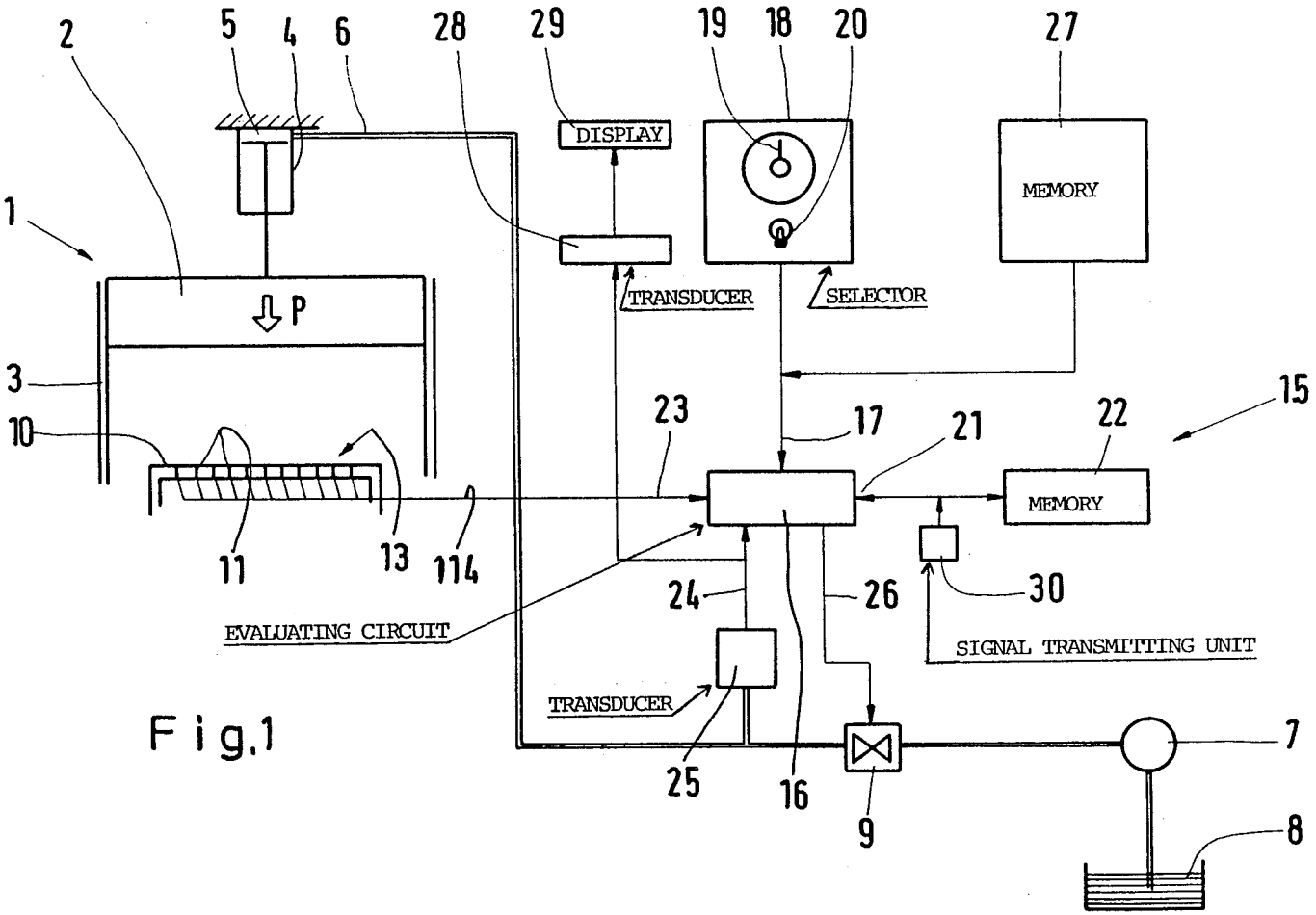
FIG. 1 is a diagrammatic view of a guillotine type cutting machine which embodies one form of the invention.

FIG. 1 shows a guillotine type cutting or severing machine 1 wherein a support 10 in the form of a horizontal table serves to support a stack of paper sheets or the like during severing by a guillotine type knife (not shown). In order to prevent any shifting of sheets in the course of the severing operation, the machine 1 further comprises a vertically movable hold-down device 2 (hereinafter called beam for short) which descends upon the topmost sheet of the stack on the table 10 and bears upon the stack with a preselected force P. The machine 1 comprises novel and improved means for selecting the magnitude of the force P as a function of the length of the cut to be made across the stack on the table 10 and as a function of other parameters. The beam 2 comprises vertically extending portions which are reciprocable in or along stationary vertical guide members 3 so that the beam can engage a stack adjacent the cutting plane, i.e., adjacent the plane wherein the guillotine type knife descends to cut across the stack.

The means for directly reciprocating the beam 2 comprises at least one cylinder and piston unit 4 operated by a hydraulic fluid which can be admitted into and evacuated from a working chamber 5 above the piston whose piston rod is affixed to the median portion of the beam 2.

The means for varying the pressure of fluid in the chamber 5, and hence the magnitude of the force P, comprises a source of pressurized hydraulic fluid including a pump 7 which draws fluid from a vessel 8 and causes pressurized fluid to flow into a conduit 6 which connects the chamber 5 with the outlet of the pump 7. The conduit 6 contains an adjustable pressure regulating valve 9 upstream of a transducer 25 which constitutes a means for monitoring the pressure in the conduit 6 downstream of the valve 9 (i.e., for indirectly monitoring the pressure of fluid in the chamber 5 and the magnitude of the force P) and for generating signals which are indicative of the monitored fluid pressure. Such signals are transmitted to the input 24 of an evaluating circuit 16 forming part of a control unit 15. The valve 9 is or can constitute a conventional relief valve whose operation can be regulated by electric signals transmitted thereto by the output 26 of the evaluating circuit 16.

Figure 3:
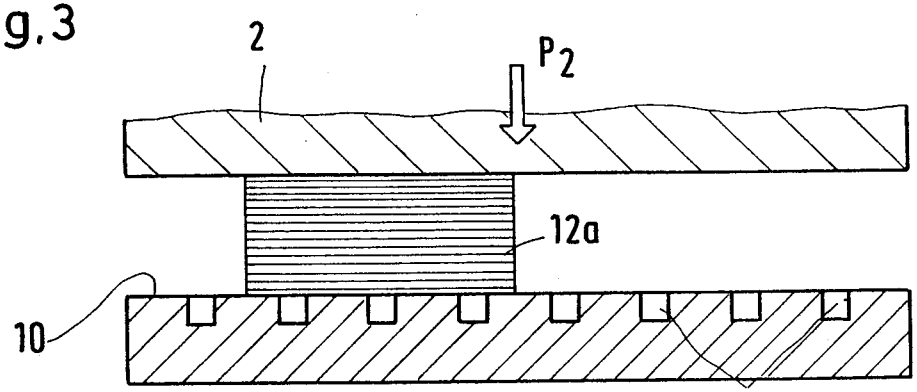
FIG. 3 shows the structure of FIG. 2 prior to severing of a smaller stack which requires a shorter cut and the application of a smaller force.
Figure 2:
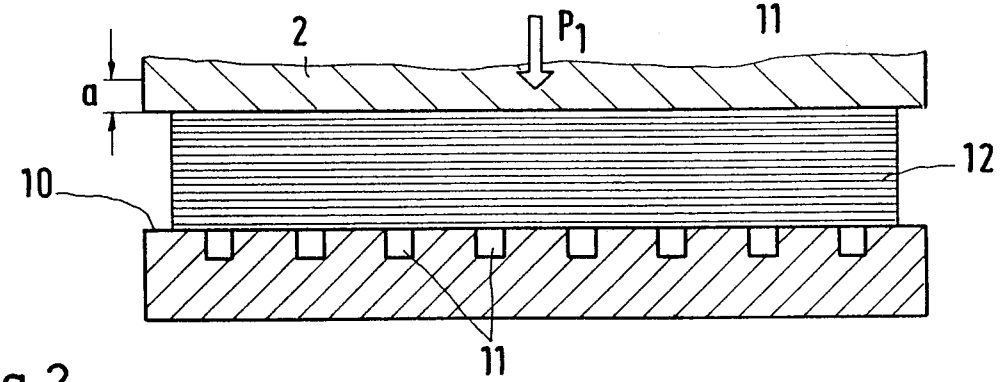
FIG. 2 is an enlarged fragmentary vertical sectional view of the support and hold-down device, further showing a relatively large stack which is to be severed while being subjected to the action of a correspondingly large force.

The machine 1 further comprises means 13 for monitoring the length of the cut to be made in a stack of sheets on the table 2, and such monitoring means comprises a row of sensors 11 (see also FIGS. 2 and 3) which are preferably embedded in or recessed into the table 10 adjacent the underside of the stack to be severed and each of which can transmit a signal to the input 23 of the evaluating circuit 16 by way of conductor means 114. FIGS. 2 and 3 show a monitoring device 13 with a row of eight equidistant sensors 11; however, the number of sensors can be reduced or increased (the same as the distances between neighboring sensors of the row) without departing from the spirit of the invention. All that counts is to ensure that the number of actuated or energized (signal transmitting) sensors 11 when the table 10 supports a stack will be accurately reflective of the length of the cut to be made in the stack.

The sensors 11 can constitute commercially available components, such as mechanically depressible or otherwise movable arms or levers, proximity detector switches, reflection type or other photoelectronic detectors, air discharging nozzles with associated pressure monitoring devices and/or a combination of such monitoring elements.

FIG. 2 shows a relatively large (long) stack 12 of superimposed paper sheets or the like whose lowermost sheet overlies all eight sensors 11 of the monitoring means 13. FIG. 3 shows a shorter or smaller stack **12*a* which overlies only three sensors 11 in the table 10. The number of overlapped sensors 11 will depend on the size (format) of the stack or upon the orientation of the stack on the table 10, i.e., whether a rectangular stack is to be severed longitudinally, diagonally or crosswise. At any rate, the number N of overlapped or activated sensors 11 is indicative of the length of the cut to be made in the stack on the table 10 of the machine 1. The intensity or another characteristic of the signal which is transmitted by monitoring means 13 to the input 23 of the evaluating circuit 16 via conductor means 14 is indicative of the length of the required cut and hence of the magnitude of the force P which is to be applied by the beam 2 in order to prevent shifting of sheets relative to each other and/or relative to the table 10** and the knife in the course of a cutting operation.

The relatively large force which is to be applied to the beam 2 during the making of a relatively long cut (stack 12 of FIG. 2) is denoted by the character $P_1$; this ensures adequate compression of the stack 12 in the region of the cutting or severing plane. The smaller force which must be applied to the beam 2 in order to properly retain a stack (**12*a*) wherein a shorter cut is to be made is shown at $P_2$ (FIG. 3). For example, a relatively long cut must be made in a stack 12 which is delivered onto the table 10, and a shorter cut is thereupon made across a portion (12*a*) of the stack 12 upon completion of the first severing operation. The magnitude of the force $P_2$ preferably equals or approximates $\frac{3}{8}$ times $P_1$. This ensures that the pressure per unit area of the stack 12 (where the stack 12 is engaged by the beam 2) is the same as or approximates the pressure per unit area of the stack 12*a* when the latter is properly engaged and held by the beam 2. It is assumed here that the height of the stacks 12 and 12*a* is the same and that the material of sheets in the stacks 12 and 12*a*** is also the same.

Figure 4:
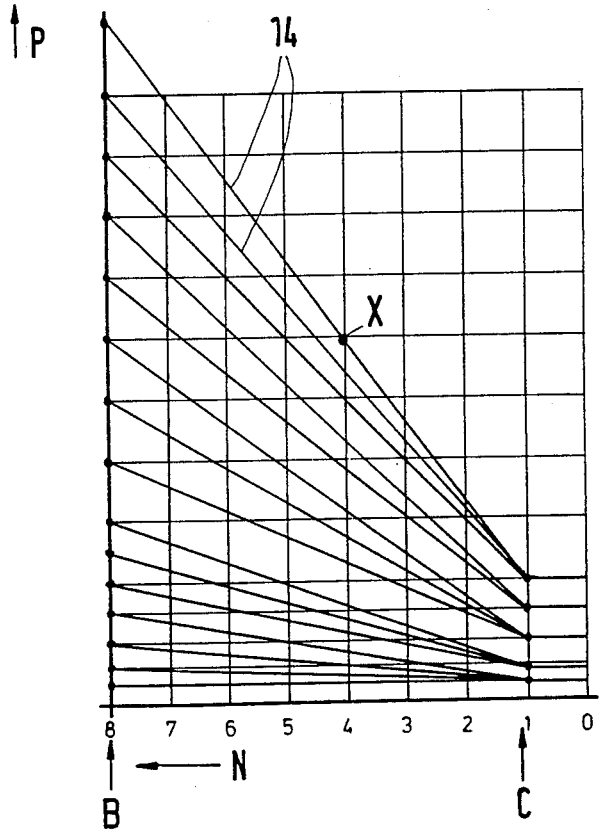
FIG. 4 is a diagram showing an array of curves denoting forces to be applied to different types and sizes of stacks.

FIG. 4 shows a bundle of curves 14 each of which is indicative of a different magnitude of force P as a function of the number N of activated or energized sensors 11. The basic force B which must be applied by the beam 2 to a stack of sheets for the making of a cut of maximum length (all eight sensors 11 energized) is measured along the left-hand ordinate (such basic force is applied in a given guillotine type severing or cutting machine). The curves 14 are straight lines from B to a particular value C which denotes the minimal force P to be applied when only one of the sensors 11 is energized. The curves 14 can be ascertained empirically (or they may be calculated) once one or more intermediate values of P have been determined. For example, if the value X of the topmost curve 14 is known (either on the basis of an experiment or by calculation), the values B and C of such curve can be ascertained by addressing a memory 22 which stores information pertaining to the curves 14 or by resorting to a computer in the evaluating circuit 16.

The control unit 15 comprises the aforementioned evaluating circuit 16, a memory 22 which contains information relating to the curves 14 shown in FIG. 4, and a basic force or curve selector 18 whose output is connected with the input 17 of the evaluating circuit 16. The selector 18 comprises a switch 19 for selection of a curve 14 denoting a force P whose basic value B is best suited for the cutting of a particular stack, i.e., for the making of a cut of selected length across a stack containing a particular number of sheets of predetermined thickness and other characteristics. A second switch 20 (e.g., a knob) of the selector 18 serves to turn on or off the means for influencing the force P in dependency on the length of the cut to be made.

The input 21 of the evaluating circuit 16 is connected with the memory 22 which serves as a means for storing information similar to that denoted by the curves 14 of FIG. 4. It suffices to merely store information pertaining to a single value of a curve, such as the value X shown in FIG. 4, denoting a particular length of the cut (i.e., a particular number of energized sensors 11), because the curves are straight lines.

The control unit 15 further comprises a programming unit (memory) 27 which is connected to the input 17 of the evaluating circuit 16 and transmits signals in accordance with a preselected program when the switch 20 is in the off position. The unit 27 stores information during a preceding cycle and can be connected with the evaluating circuit 16 if the immediately following next cycle or any next cycle involves the same type of severing operation as the preceding one.

A transducer 28 is connected with the input 24 of the evaluating circuit 16 and transmits signals to a display unit 29 which allows for visual observation of the applied force P.

The first step involves a selection of the basic force B by the selector 18. Thus, the selector 18 picks one of the curves 14 from the information which is stored in the memory 22. The evaluating circuit 16 addresses the memory 22 in accordance with the signal at its input 23, i.e., a signal denoting the number N of sensors 11 which are activated by the stack on the table 10. The output 26 transmits a corresponding signal to the valve 9 which, in turn, selects the desired pressure in the conduit 6 downstream of the valve 9, i.e., a force P which is dependent on the length of the cut to be made in the stack on the table 10. The evaluating circuit 16 comprises a signal comparing stage which compares the signal at the output 26 with the signal at the input 24 to ascertain whether or not the selected force P matches the actually applied force, and the signal at the output 26 is corrected if the actually applied force deviates from the desired or optimum force. If the length of the cut is to be changed for the next cycle (e.g., because the knife is to sever a portion of the originally delivered stack), the magnitude of the force P is reduced automatically in response to a signal or to signals from a lesser number of energized or activated sensors 11. The result is that the pressure per unit area of that part of a stack which is biased by the beam 2 remains at least substantially constant.

If the machine 1 is to cut a different type of material, the switch 19 is actuated to adjust the selector 18 accordingly so that the latter selects corresponding information denoted by a different curve 14) which is stored in the memory 22, and such information is processed by the evaluating circuit 16 in dependency on the intensity or another characteristic of the signal at the input 23 (i.e., in dependency on the number of energized sensors 11). From there on, the mode of operation is the same as described above.

In a learning mode, the force P can be selected with an auxiliary signal admitting unit 30. This unit enables the operator to alter an arbitrarily selected signal at the input 21 until the display unit 29 indicates a force P of desired magnitude, i.e., a desired hydraulic fluid pressure in the chamber 5 of the cylinder and piston unit 4. Such signal is then transferred into the memory 22 so that one ensures that the memory stores information which, in the machine 1, corresponds exactly to a given force P. In this manner, one can ascertain and thereupon store in the memory 22 information denoting the maximum values B and the minimum values C for each curve 14. The intermediate values of each such curve can be ascertained by a computer in the evaluating circuit 16. The just discussed feature of the control unit 15 renders it possible to employ this unit in conjunction with larger or smaller severing or cutting machines of different types. All that is necessary is to memorize a plurality of data (bundle of curves 14) for a particular machine and to make the adjustments (if necessary) by way of the unit 30 in a manner as described above. This renders it possible to take into consideration all parameters of a particular machine and to select the force P with a very high degree of accuracy.

The reason that information which is stored in the memory 22 merely corresponds to the bundle of curves 14 shown in FIG. 4 is that the memory 22 stores electrical data which must be translated into forces of corresponding magnitude upon transmission of such data to the evaluating circuit 16.

Selection of basic forces B with assistance from the switch 19 is carried out on the basis of data gathered during previous utilizations of the machine or on the basis of a test run which involves compression or compacting of a stack 12 on the table 10. Thus, the stack (note the stack 12 of FIG. 2) can be subjected to a compacting force in response to the application of a selected force to the beam 2 whereby the height of the compressed stack is reduced by the value a. For example, the initial contact between the underside of the beam 2 and the stack 12 of FIG. 2 can be ascertained by a photoelectronic or other suitable detector (not shown), and another detector can monitor and signal the extent of downward movement of the beam 2 upon the establishment of initial contact. The magnitude of the force P which is required to properly hold a stack against shifting or other stray movements in the course of a severing operation is or can be said to be directly proportional to the distance a.

Figure 5:
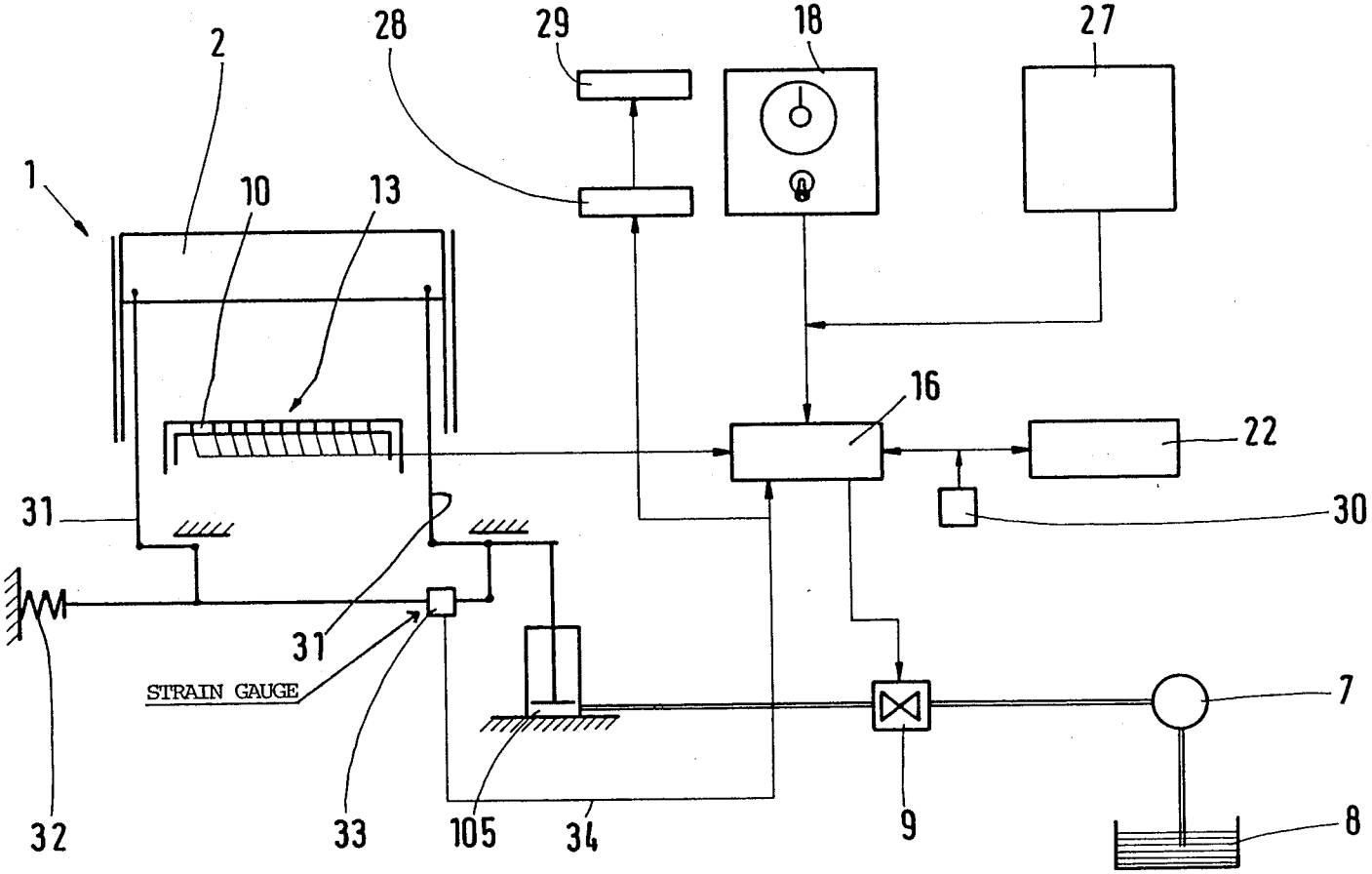
FIG. 5 is a diagrammatic view of a second cutting machine.

The machine 1 which is shown in FIG. 5 deviates from the machine of FIG. 1 in that the beam 2 is pulled rather than pushed toward the topmost sheet of a stack on the table 10. Pressurized fluid which passes from the outlet of the pump 7, through the valve 9 and into the chamber 105 of the cylinder and piston unit shown in FIG. 5 acts upon a mechanical motion transmitting linkage 31 which, in turn, pulls the beam 2 downwardly toward the table 10. A restoring device 32 (shown schematically in the form of a coil spring) is used to normally urge the beam 2 upwardly and away from the table 10. A force measuring device 33 is provided to transmit signals to the corresponding input of the evaluating circuit 16, such signals being indicative of the magnitude of the force which is being applied by the beam 2. By way of example, the force measuring device 33 can include a conventional wire strain gauge. In all other respects, the operation of the control unit which is shown in FIG. 5 corresponds to that of the control unit 15 of FIG. 1.

The learning mode can be carried out automatically if the unit 30 is designed to automatically select a particular force and to automatically store the corresponding signal in the memory 22. The control unit then automatically shifts to the next learning mode so that the entire calibrating operation is completed within a few minutes.

The selector 18 receives encoded information pertaining to the basic value of the force P.

The improved machine is susceptible of many additional modifications. For example, the illustrated monitoring means 13 can be replaced with monitoring means for mechanical or contact-free determination of the desired length of a cut, e.g., with mechanical sensors or by optically monitoring the distance between two edge faces at the two ends of the proposed or contemplated cut.

An important advantage of the improved method and machine is that the person in charge is merely required to select a basic force by actuating the switch 19 whereupon the control circuit 15 takes over and regulates the magnitude of the force P on the basis of information which is stored in the memory 22 or on the basis of information which is stored in the memory 27. The basic force which is selected at 18, 19 is characteristic of the material of the sheets on the table 10 and/or of the number of sheets, and the regulation which is carried out by the evaluating circuit 16 takes care of variations of the length of cuts to be made. As mentioned above, the information which is selected by the switch 19 can be ascertained with a high degree of accuracy on the basis of test runs (to measure the extent of compression of a stack as shown in FIG. 2) which is analogous to obtaining information from the memory 27, i.e., on the basis of information which was gathered during cutting of similar stacks in the same machine or in an identical machine. The length of cuts to be made is monitored automatically at 13 not later than when the beam 2 descends, i.e., immediately prior to an actual cutting operation, so that the operation of the machine is not dependent upon the skill and/or carefulness of the attendant or attendants. Moreover, the output of the machine is much higher than that of a manually operated machine because any adjustments which are warranted due to changes in the length of the cuts to be made are attended to by the control unit 15 in a fully automatic way. Still further, the quality of each cut is satisfactory from one end to the other because the magnitude of the force P which is applied by the beam 2 is properly selected along the entire row of active sensors 11, i.e., along the overlapped part of the row of sensors which together form the monitoring means 13. Such uniformity of cuts is desirable and advantageous because it prolongs the useful life of the knife as well as of the entire cutting machine.

It has been found that the pressure per unit area of those parts of successively treated stacks which are overlapped and pressurized by the beam 2 will remain constant, or will deviate only slightly from a desired value, if the force P decreases at least substantially proportionally with a reduction of the length of cuts, i.e., from the making of a longer cut in a first stack to the making of a shorter cut in the next-following stack. Reliance on such simple relationship between larger and smaller forces (on the basis of a determination of the length of proposed or contemplated cuts) has been found to be satisfactory in many or most instances. This is shown in FIG. 4 wherein each curve is a straight line which slopes from B to C proportionally with a reduction in the number N of overlapped (energized or activated) sensors 11, i.e., proportionally with the length of the stack on the table 10 (and more specifically in proportion to the length of the cut to be made in such stack). Since the basic value B is ascertained for the longest cut to be made in a stack which contains a predetermined number of sheets of a particular quality, eventual errors in connection with the selection of such basic value diminish with a reduction of the length of cuts so that the error during the making of a short cut is very small or negligible.

An advantage of the memory 22 is that a proper pressure P can be determined in immediate response to transmission of a signal from the monitoring means 13 to the evaluating circuit 16 by way of conductor means 114; the circuit 16 then addresses the memory 22 and the information (denoted by a curve 14) is available immediately without any further calculation. The information which is stored in the memory 22 can be gathered on the basis of all parameters which influence the cutting operation in a specific cutting machine.

Since the sensors 11 form a row at a level below the beam 2 and in line with the action of the beam upon a stack on the table 10, the monitoring means 13 invariably generates a signal of requisite intensity, i.e., a signal which is truly indicative of the length of the contemplated cut. Moreover, such distribution of sensors 13 below the beam 2 ensures that the signal which is generated by the monitoring means 13 is truly indicative of the length of the contemplated cut regardless of whether the stack to be cut is nearer to the one or the other side or end of the table 10, i.e., the signal from 13 invariably denotes the length of the cut which is about to be made in the stock on the table. Each sensor 11 generates a signal whose intensity or another characteristic is indicative of a unit length of the cut, i.e., the sum of signals from overlapped sensors is an accurate indicator of the length of a cut.

If the evaluating circuit 16 embodies a computer, the memory 22 merely stores one or two bits of information for each curve 14. The remaining part of a selected curve is then determined by extrapolation or interpolation in the evaluating circuit 16 which transmits corresponding signals to the valve 9 in order to regulate the pressure in the chamber 5 and hence the magnitude of the force P as a function of the intensity and/or other characteristics of signals which are transmitted via conductor means 114. Information which is stored in the memory 22 can be transferred into a working memory of the evaluating circuit 16 in response to each signal from the monitoring means 13. The information which is stored in the working memory is compared with the signal from the transducer 25, and the output 26 transmits to the valve 9 a signal when the characteristics of the signal in the working memory deviate from the characteristics of the signal at the input 24. The comparison can be carried out by any suitable conventional signal comparing stage.

The following devices are suitable for use in the described apparatus:

Control unit 15 by Wessel-Hydraulic, type No. 061.514.001.7 comprising:
- evaluation circuit 16 (microprocessor unit based on ZILOG Z80)
- memory 22 (battery backed-up static CMOS-RAM)
- signal transmitting unit (potentiometer with A/D-Converter)

Selector 18 by RUF, type No. 1548-001 (BCD-switch with 15 positions)

Transducer 25 by Wessel-Hydraulic, type No. 583.514.007.9

Memory 27 by POLAR-MOHR, type No. 020242 (battery backed-up static CMOS-RAM)

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of regulating the force with which stacks of overlapping sheets are biased against a support during severing in a machine wherein stacks requiring longer and shorter cuts are severed in a predetermined or random sequence, comprising the steps of monitoring the stacks including ascertaining the lengths of the cuts to be made therein and generating signals whose characteristics are indicative of the ascertained lengths; selecting a basic force; and altering said basic force for each stack as a function of the characteristics of the respective signal so that the applied force is greater when the cut to be made is longer and lesser when the cut to be made is shorter.

2. The method of claim 1, wherein the force is applied to stacks by a hold-down device which is movable with reference to the support to exert pressure upon a stack on the support, said altering step including varying the basic force in such a way that the pressure per unit area of contact between the hold-down device and the stack on the support is at least substantially constant.

3. The method of claim 1, wherein said selecting step includes selecting the basic force for a cut of maximum length in a stack containing a particular sheet material, said altering step including reducing the basic force substantially proportionally with a reduction of the length of the cut to be made.

4. The method of claim 1, further comprising the step of storing a plurality of data pertaining to different types of stacks and denoting variations of the basic force in relation to the lengths of cuts to be made in the respective types of stacks, said selecting step including selecting one of said plurality of data and said altering step including choosing from selected data that value which corresponds to the length of the cut to be made.

5. The method of claim 4, wherein said storing step includes arbitrarily varying an auxiliary value until it corresponds to the desired force and thereupon memorizing the auxiliary value corresponding to the desired force.

6. The method of claim 5, further comprising the step of calculating the remaining values of said data on the basis of the memorized auxiliary values.

7. The method of claim 4, wherein the stored data denote variations of the basic force as a function of the length of the cuts to be made in the respective types of stacks.

8. The method of claim 7, wherein said data are represented by curves.

9. The method of claim 1 of regulating the force in a machine wherein cuts are made in a predetermined plane, said monitoring step including ascertaining the lengths of cuts to be made in or close to said plane.

10. The method of claim 1, wherein said selecting step includes determining a different basic force for each length of the cut and said determining step includes subjecting a stack in which a cut of a given length is to be made to the action of a compressing force so that the respective dimension of the stack is reduced under the action of said compressing force, measuring the extent of reduction of said dimension, and utilizing the result of such measurement to calculate the corresponding basic force.

11. A severing machine for making shorter and longer cuts in stacks of overlapping sheets, comprising a support for a stack to be cut; a hold-down device movable with reference to said support to apply to the stack on said support a force during severing of the stacks; and control means for regulating said force, including means for monitoring the stack on said support and for generating signals having characteristics denoting the length of the cut to be made in the stack, and means for selecting for each stack a basic force which is altered as a function of the characteristics of the corresponding signal so that the force is greater when the cut to be made is longer and lesser when the cut to be made is shorter.

12. The machine of claim 11, wherein said hold-down device is disposed at a level above said support and said monitoring means is provided on or in said support.

13. The machine of claim 11, wherein said monitoring means includes a row of signal transmitting sensors and the number of sensors which transmit signals in the course of a monitoring operation is a function of the extent to which the row is overlapped by a stack on said support.

14. The machine of claim 13, wherein said control means further comprises an evaluating circuit which is responsive to signals from sensors forming the overlapped part of said row of sensors.

15. The machine of claim 11, wherein said control means further comprises at least one memory for data denoting forces for cuts of different lengths and means for addressing said memory in response to signals from sensors forming the overlapped part of the row of sensors.

16. The machine of claim 11, wherein said control means further comprises at least one fluid-operated cylinder and piston unit for moving said hold-down device toward said support and means for varying the pressure of fluid in said unit.

17. The machine of claim 16, wherein said varying means includes a source of pressurized fluid, conduit means connecting said source with said unit, and adjustable valve means in said conduit means.

18. The machine of claim 17, wherein said control means further comprises means for adjusting said valve means in response to said signals including an evaluating circuit arranged to receive said signals, said selecting means including a source of second signals denoting the basic force for different types of stacks, said source of second signals being connected with said evaluating circuit and said control means further comprising a memory containing information denoting variations of the basic forces as a function of the length of the cuts and connected with said evaluating circuit, and means for transmitting to said evaluating circuit signals denoting the pressure of fluid in said unit.

19. The machine of claim 18, wherein said control means further comprises a second memory connectable with said evaluating circuit and arranged to store information denoting basic forces for different types of stacks.

* * * * *